United States Patent [19]

Walsh

[11] Patent Number: 4,789,062

[45] Date of Patent: Dec. 6, 1988

[54] CARRIER FOR EMPTY BEVERAGE CONTAINERS

[76] Inventor: James F. Walsh, 136 Halwill Dr., Snyder, N.Y. 14226

[21] Appl. No.: 68,109

[22] Filed: Jun. 29, 1987

Related U.S. Application Data

[63] Continuation of Ser. No. 771,636, Sep. 3, 1985, abandoned.

[51] Int. Cl.[4] ..... B65D 75/00

[52] U.S. Cl. ..... 206/427; 206/167; 206/443; 294/160; 294/162

[58] Field of Search ..... 206/139, 167, 427, 430, 206/445, 443, 499; 217/19; 220/19, 21; 294/159–163; 24/616, 513

[56] References Cited

U.S. PATENT DOCUMENTS

| | | | |
|---|---|---|---|
| 4,290,525 | 9/1981 | Sisson | 206/427 |
| 4,574,978 | 3/1986 | Hodges | 206/427 |
| 4,671,405 | 6/1987 | Hagan | 206/139 |

*Primary Examiner*—David T. Fidei

*Attorney, Agent, or Firm*—Joseph P. Gastel

[57] ABSTRACT

A carrier for empty beverage containers including a plurality of vertical tubes within a housing, a cover for the housing, a slidable door at the bottom of the housing to permit discharge of empty beverage containers from the tubes, and spaces between the tubes for permitting ventilation within the housing.

20 Claims, 2 Drawing Sheets

Fig. 1.
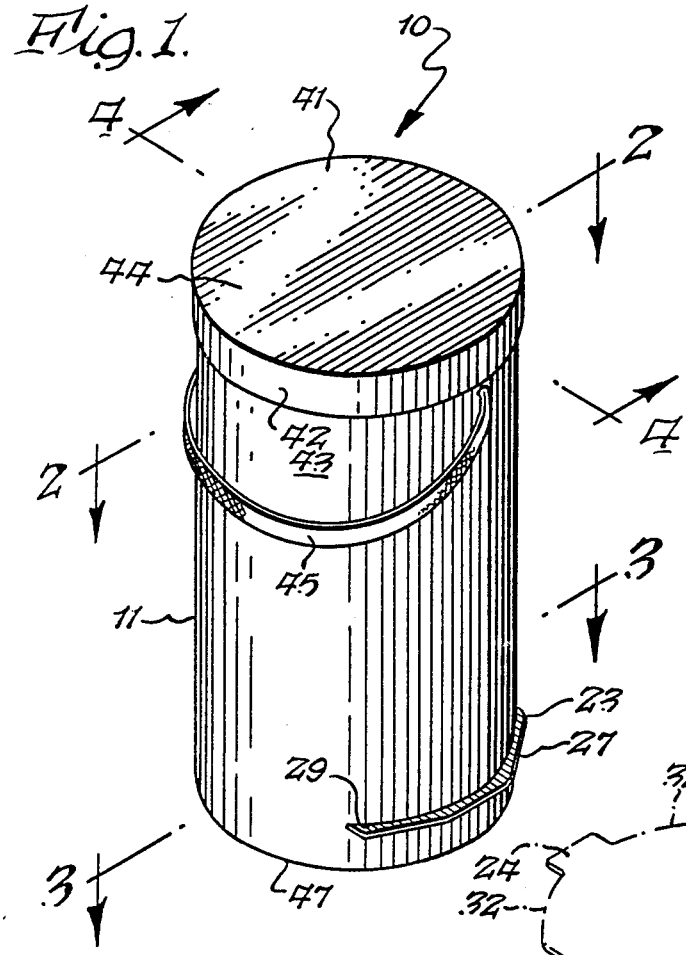
Fig. 7.
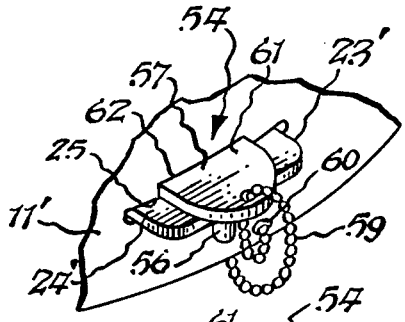
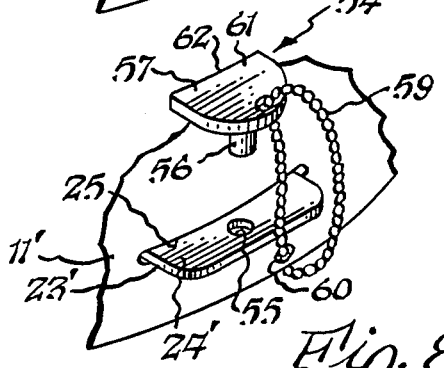
Fig. 8.
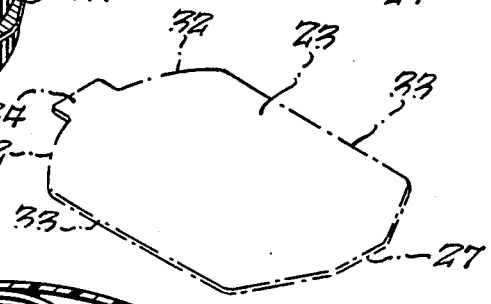
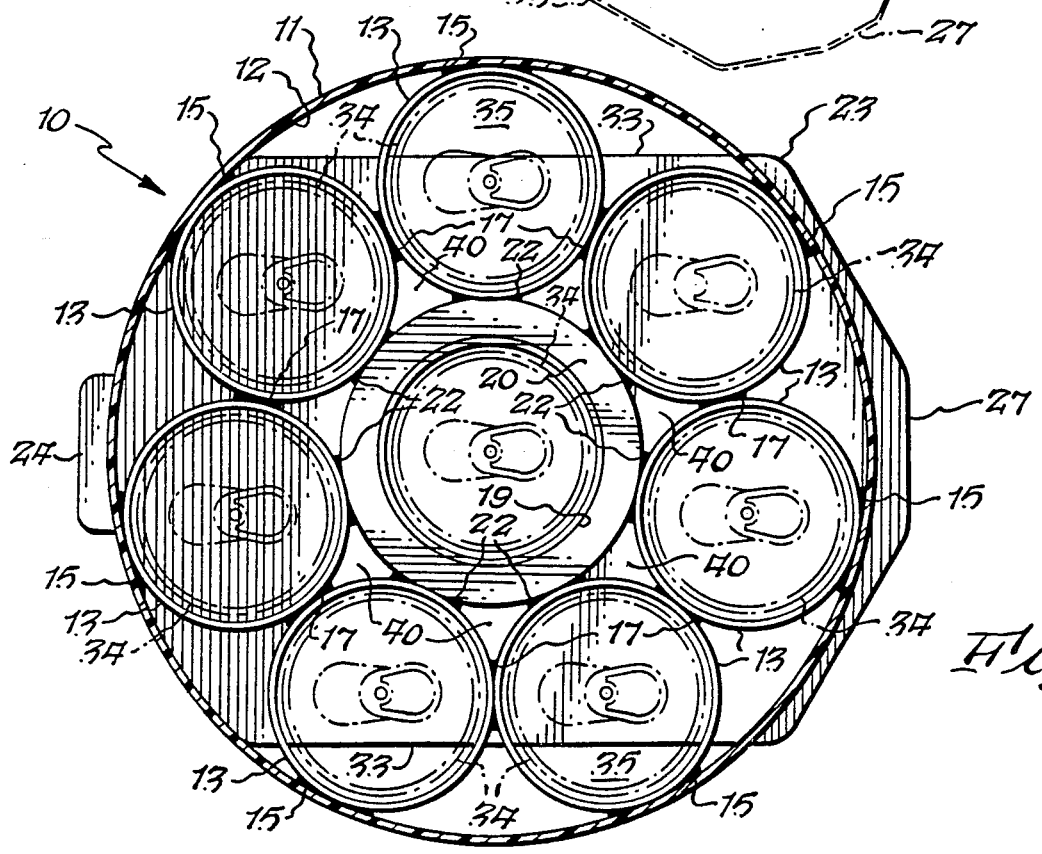
Fig. 2.

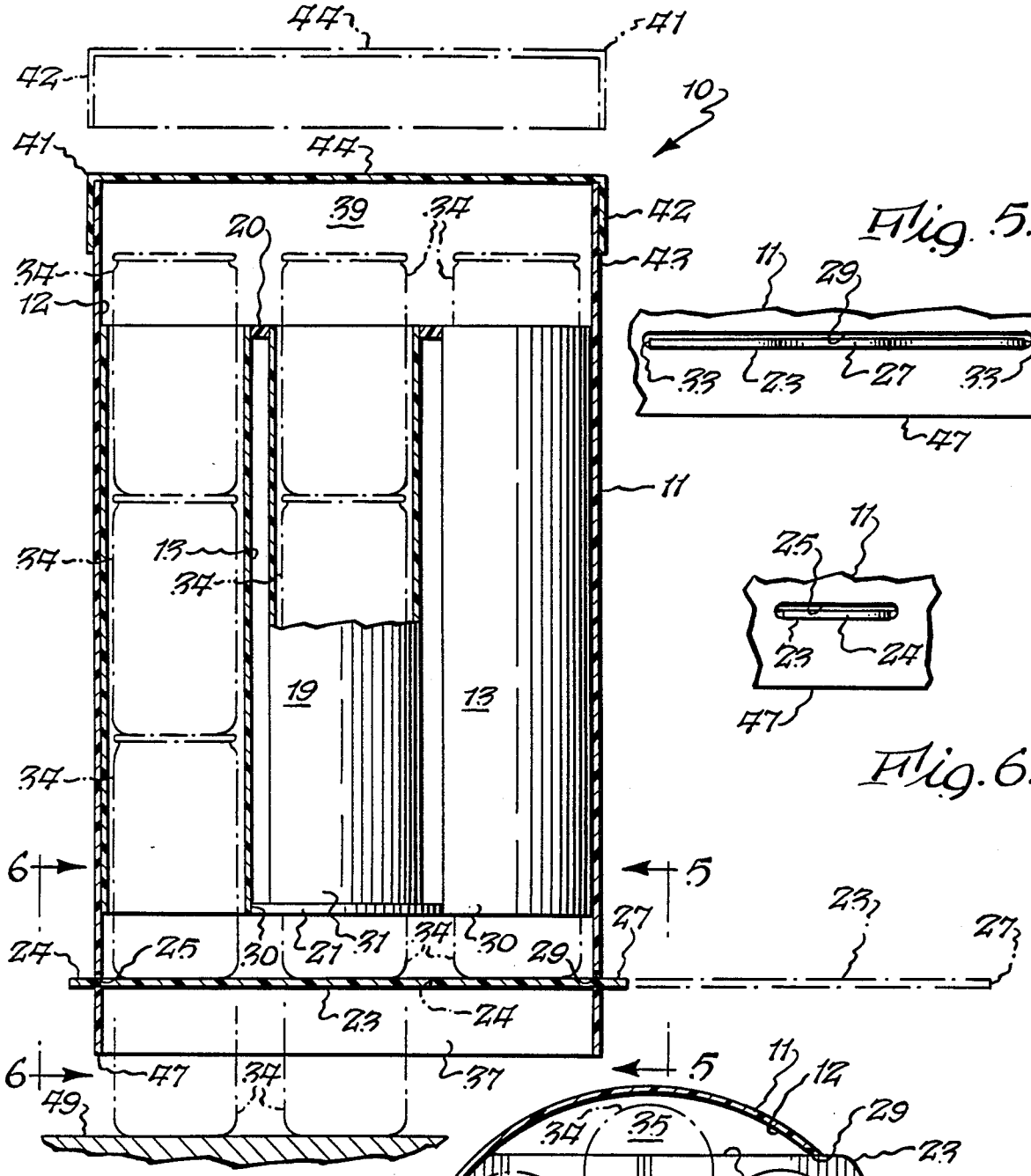
Fig. 4.
Fig. 5.
Fig. 6.
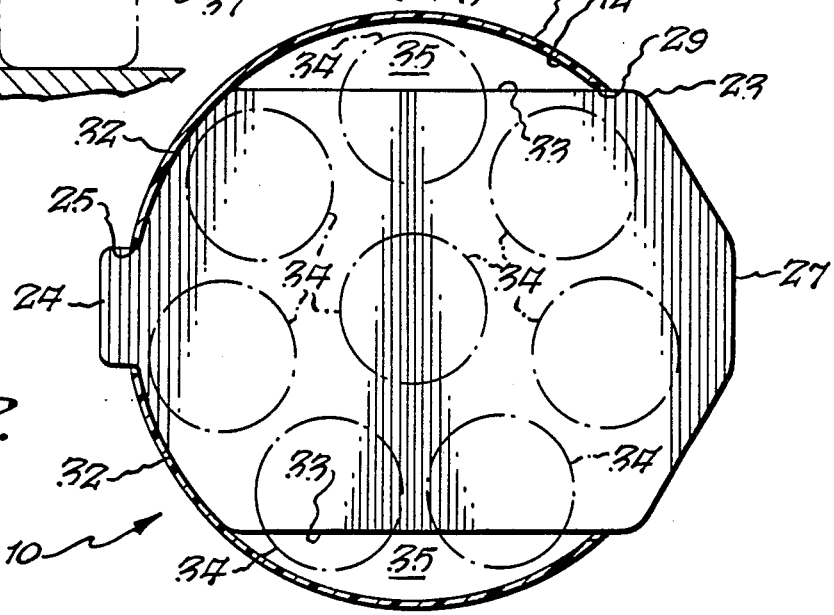
Fig. 3.

CARRIER FOR EMPTY BEVERAGE CONTAINERS

This is a continuation, of application Ser. No. 771,636 filed Sept. 3, 1985, now abandoned.

BACKGROUND OF THE INVENTION

The present invention relates to an improved carrier for returning empty beverage containers to return areas.

By way of background, legislation in various states has mandated the return of empty beverage containers, such as metal cans and bottles, to reduce pollution. Various types of carriers have been devised for this purpose. However, most of the containers were either paper boxes or carriers which wore rapidly. Other carriers stacked the empty containers on their sides and thus permitted spilling of the residual contents. Still other carriers were rather complex and awkward to use.

SUMMARY OF THE INVENTION

It is one object of the present invention to provide an improved carrier for empty beverage containers which stores them in an upright condition, thereby eliminating spilling of the residual contents.

Anther object of the present invention is to provide an improved covered carrier for empty beverage containers which is ventilated in an unique manner so as to obviate odors.

A further object of the present invention is to provide an improved carrier for empty beverage containers which can be filled in an extremely simple manner and from which the empty beverage containers can be discharged in an extremely simple and convenient manner without inverting them. Other objects and attendant advantages of the present invention will readily be perceived hereafter.

The present invention relates to a carrier for empty beverage containers comprising a plurality of vertical tubes having tops and bottoms, means for securing said vertical tubes into a bundle, and door means proximate said bottoms for permitting said containers to drop from said vertical tubes.

The various aspects of the present invention will be more fully understood when the following portions of the specification are read in conjunction with the accompanying drawings wherein:

BRIEF DESCRIPTION OF THE DRAWINGS

FIG. 1 is a perspective view of the improved carrier of the present invention;

FIG. 2 is a cross sectional view taken substantially along line 2—2 of FIG. 1 and showing the relationship between the vertical tubes within the housing and the manner in which empty beverage cans are positioned within the vertical tubes;

FIG. 3 is a cross sectional view taken substantially along line 3—3 of FIG. 1 and showing the manner in which the slidable door fits into the housing;

FIG. 4 is a cross sectional view taken substantially along line 4—4 of FIG. 1 and showing the relationship between the housing, the vertical tubes, empty beverage cans within the tubes, and the slidable door at the bottom of the housing;

FIG. 5 is a fragmentary side elevational view taken substantially in the direction of arrows 5—5 of FIG. 4 and showing the housing and the wide end of the slidable door;

FIG. 6 is a fragmentary side elevational view taken substantially in the direction of arrows 6—6 of FIG. 4 and showing the housing and the narrow end of the slidable door.

FIG. 7 is a fragmentary perspective view of a modified form of the carrier which incorporates a lock for the slidable door with the lock in locked condition; and FIG. 8 is a view similar to FIG. 7 with the lock in unlocked condition.

DESCRIPTION OF THE PREFERRED EMBODIMENTS

The empty beverage container carrier 10 includes a cylindrical housing 11 which is preferably fabricated of sheet plastic because it will not absorb liquids, but which may be fabricated of suitable fiberboard or other materials. A plurality of tubes 13, which are preferably fabricated of sheet plastic which will not absorb liquids but which may be fabricated of suitable fiberboard or other materials, are formed in a circle with their sides contacting the inner cylindrical surface 12 of housing 11 and connected thereto in any suitable manner as by adhesive, or any other type of connection, at their contacting areas 15. In addition, vertical tubes 13 are connected to each other at their contacting areas 17 in the same manner. In addition, a vertical tube 19 is located centrally within tubes 13. In this regard, an upper spacer ring 20 and a lower spacer ring 21 may encircle the top and bottom, respectively, of tube 19 and be suitably secured thereto and also secured to vertical tubes 13 at areas 22 by any suitable method. As can be seen from FIG. 4, housing 11 is longer than tubes 13 and 19.

A slidable door 23 has a narrow tab 24 which is received in slot 25 in housing 11. Door 23 also includes a wide end 27 which is received in slot 29 when door 23 obstructs the bottoms 30 of tubes 13 and the bottom 31 of tube 19. Door 23 also includes curved portions 32 on each side of tab 24. Curved portions 32 have the same radius as housing 11 and thus fit flush against internal surface 12 thereof. Door 23 also includes straight sides 33 which are spaced from internal surface 12 of housing 11. Door 23 is in its closed position in the drawings, and it will be understood that it can be removed to its phantom line open position shown in FIGS. 1 and 4. In its closed position it obstructs the bottoms 30 and 31 of tubes 13 and 19, respectively, which are each of a length to receive three metal cans 34.

As can be seen from FIG. 3, there are open spaces 35 between door sides 33 and housing surface 12. Furthermore, the bottom portion 37 of housing 11 is open. Therefore air can circulate upwardly into housing 11 by passing through spaces 35 and the various other spaces between certain of the vertical tubes 13. Furthermore, since there is a space 39 above cans 34, the air can circulate in this area also and downwardly into the spaces 40 and into the tubes 13 and 19 themselves. Ventilation is desirable because the empty beverage cans 34 may have beer or softdrink odors which could become objectionable in the event that there was no ventilation.

A cover 41 includes a cylindrical side wall 42 which fits snugly on the outside surface 43 of housing 11 and it has a top wall 44 which closes housing 11. A fabric handle 45 in the nature of a bail is suitably affixed to housing 11 for carrying the carrier 10.

In use, the door 23 is installed in an empty housing 11 so that it occupies the solid position shown in the drawings. Thereafter, empty metal beverage containers 34 are dropped into tubes 13 and 19, each of which can accommodate three containers, for a total of twenty-four. The number of twenty-four is desirable because this is equivalent to four six-packs or three eight-packs or two twelve-packs. As can be seen from FIGS. 2 and 5, the empty beverage containers 34 are maintained in an upright position in their tubes so that there will be no spilling of the residual contents thereof, such spilling being objectionable because the food products not only would produce odors but would also attract insects.

When the carrier is brought to the return point which receives the empty beverage containers 34, it is merely necessary to set the bottom 47 of housing 11 on a table surface 49 or the like and when the sliding door 23 is withdrawn, the lowermost beverage containers will slide downwardly and rest on surface 49, and the upper empty beverage containers will also move downwardly. Thereafter, housing 11 can be lifted vertically to leave the empty beverage containers standing vertically stacked three high in eight columns wherein they can be inspected by the personnel in charge of receiving empties. Thereafter, sliding door 23 is reinserted into slots 25 and 29 and is taken back to be refilled with empties. During the emptying of carrier 10, cover 41 does not even have to be removed. It is only necessary to remove it when it is being filled with empties.

In FIGS. 7 and 8 a modified form of the present invention is shown which includes a lock 54 for preventing the slidable door from being accidently slid to a position wherein the small tab moves out of slot 25. In this form slidable door 23' is identical in all respects to slidable door 23, described previously, except for a hole 55 in tab 24' which receives a pin 56 of locking member 57 which is chained to housing 11' by chain 59 which passes through a hole 60 in housing 11'. Locking member 57 includes an integral enlarged head portion 61 which is grasped during insertion and removal of pin 56. Head portion 61 includes a curved end surface 62 for complementary engagement with the side of housing 11', which is identical to housing 11, except for the above-described hole 60.

While the carrier 10 has been described in conjunction with empty cans, it will be appreciated that it can also be used for empty bottles in substantially the same manner, except that the bottles will not remain stacked in columns when removed from the tubes in the above-described manner. By way of example, the plastic tubes 13 and 19 have an internal diameter of approximately $2\frac{3}{4}$ inches to receive cans having a diameter of approximately $2\frac{1}{4}$ inches. This relationship permits the cans to be inserted and removed easily but the cans will not tip. Furthermore, it is preferably that the vertical tubes 13 and 19 be slightly shorter than the length of three cans 34 placed end-to-end for the dual purpose of saving material and for enhancing ventilation.

While the housing and the vertical tubes have been disclosed as cylindrical, it will be appreciated that they may take any other desired cross sectional shape. In this respect, the tubes may be square and the housing may be rectangular in cross section. Furthermore, the square tubes may abut each other so that there are no spaces in between, in which event the desired ventilation would be obtained through the spaces between the cans and the inner sides of the tubes. Furthermore, the square tubes may be oriented in two rows of four columns each.

While the door 23 has been shown as being of the sliding type, it will be appreciated that it may be of any other type which will perform the intended function. All parts of the carrier are preferably made of sheet plastic which will not absorb liquids. However, where one or more parts of the carrier are made of materials other than sheet plastic, such as fiberboard, such materials are preferably coated with a coating which will repel liquids for sanitation reasons, that is, so they can be washed without damage and so that they will not absorb liquids.

While preferred embodiments of the present invention have been disclosed, it will be appreciated that it is not limited thereto but may be otherwise embodied within the scope of the following claims.

What is claimed is:

1. A carrier for vertically oriented empty beverage containers, having openings in their upper portions and having first longitudinal axes, comprising a plurality of vertical compartments having second longitudinal axes and having tops and bottoms, each of said compartments being of a length greater than the length of each of said beverage containers so that a plurality of said beverage containers can be received in each of said vertical compartments with said first axes in substantial alignment with said second axes and with their upper portions facing upwardly so that there is no spilling of liquid from their openings, a housing for enclosing said compartments in a lateral direction and having a housing top and a housing bottom proximate said tops and bottoms, respectively, of said compartments for containing said vertical compartments, door means in said housing proximate said bottoms of said compartments for holding said containers in said compartments when said door is closed and for permitting said containers to drop from said vertical compartments when said door is open, and a cover for said housing overlying all of said compartments and spaced from said tops of said compartments to close said housing to confine odors therein while said spacing of said cover from said tops permits ventilation among said tops of said compartments.

2. A carrier for empty beverage containers as set forth in claim 1 including a handle on said housing proximate said housing top for carrying said carrier.

3. A carrier for empty beverage containers as set forth in claim 1 including slot means in said housing proximate said housing bottom, and wherein said door means comprises a plate slidable through said slot means proximate said bottoms of said vertical compartments.

4. A carrier for empty beverage containers as set forth in claim 3 wherein said plate includes a tab at one end thereof, and wherein said slot means comprises a first slot on one side of said housing through which said plate passes and a second slot on the opposite side of said housing through which said tab passes.

5. A carrier for empty beverage containers as set forth in claim 4 including a hole in said tab, and pin means for insertion into said tab when said tab extends outwardly of said housing, to thereby lock said plate against movement out of said housing.

6. A carrier for empty beverage containers as set forth in claim 5 including means for fastening said pin means to said housing,

7. A carrier for empty beverage containers as set forth in claim 3 including handle means secured to said housing proximate said housing top.

8. A carrier for empty beverage containers as set forth in claim 1 wherein said plurality of vertical compartments comprise seven cylindrical tubes formed in a circle with their axes parallel to each other and surrounding an eighth circular tube which is parallel thereto.

9. A carrier for empty beverage containers as set forth in claim 8 wherein said cylindrical compartments are of a length to receive at least three beverage containers.

10. A carrier for empty beverage containers as set forth in claim 1 wherein said compartments are cylindrical.

11. A carrier for empty beverage containers as set forth in claim 1 wherein said door means does not fully obstruct said bottoms of all of said compartments, thereby permitting ventilation to at least some of said compartments through said housing bottom.

12. A carrier for empty beverage containers as set forth in claim 11 including spaces between said compartments whereby there can be ventilation from said door means which does not obstruct all of said compartments through said spaces between said compartments into the tops of said compartments.

13. A carrier for empty beverage containers as set forth in claim 11 wherein said compartments are slightly wider than said beverage containers to permit ventilation through said compartments when they contain said beverage containers.

14. A carrier for empty beverage containers as set forth in claim 13 wherein said door means is spaced from said bottoms of said compartments to permit ventilation from said housing bottom into all of said compartments.

15. A carrier for vertically oriented empty beverage containers having openings in their upper portions and having first longitudinal axes comprising a plurality of vertical compartments having second longitudinal axes and having tops and bottoms, each of said compartments being of a length greater than the length of each of said beverage containers so that a plurality of said beverage containers can be received in each of said vertical compartments with said first axes in substantial alignment with said second axes and with their upper portions facing upwardly so that there is no spilling of liquid from their openings, a housing for enclosing said compartments in a lateral direction and having a housing top and a housing bottom proximate said tops and bottoms, respectively, of said compartments for containing said vertical compartments, and door means in said housing proximate said bottoms of said compartments for permitting said containers with their openings in their upper portions to descend from said vertical compartments while still oriented vertically.

16. A carrier for empty beverage containers as set forth in claim 15 including a cover for said housing overlying said compartments.

17. A carrier for empty beverage containers as set forth in claim 16 wherein said compartments are wider than said beverage containers, and opening means at said housing bottom to permit ventilation into said compartments.

18. A carrier for empty beverage containers as set forth in claim 17 including spaces between said compartments to permit ventilation into said spaces through said opening means.

19. A carrier for empty beverage containers as set forth in claim 11 wherein said housing bottom extends downwardly beyond said door means and includes an end portion which rests on the ground so that there is an empty space below said door which is confined laterally by said bottom of said housing whereby there can be ventilation between said empty space and said at least some of said compartments.

20. A carrier for empty beverage containers as set forth in claim 19 wherein said housing bottom includes an extreme end which lies in a single plane so that when said extreme end rests on a planar surface said empty space is entirely confined so that odors cannot be transmitted beyond said housing bottom.

* * * * *